US005833805A

United States Patent [19]

Emery

[11] Patent Number: 5,833,805

[45] Date of Patent: Nov. 10, 1998

[54] COMPOSITE HOLLOW MOULDED PANELS AND METHODS OF MANUFACTURE

[76] Inventor: Roy William Emery, 1 Donino Court, Toronto, Ontario, Canada, M4N 2H6

[21] Appl. No.: 752,331

[22] Filed: Nov. 19, 1996

Related U.S. Application Data

[63] Continuation-in-part of Ser. No. 370,528, Jan. 9, 1995, abandoned, and Ser. No. 247,009, May 20, 1994, abandoned.

[51] Int. Cl.[6] ..... D21H 11/00; B32B 3/00; B28B 1/26

[52] U.S. Cl. ..... 162/109; 162/116; 162/217; 162/220; 156/204; 156/217; 156/292; 264/86; 264/87; 264/517; 264/313; 264/319

[58] Field of Search ..... 428/156, 172; 162/109, 116, 210, 217, 218, 220, 391, 396; 156/204, 209, 217, 227, 292; 264/86, 87, 517, 519, 313, 319

[56] References Cited

U.S. PATENT DOCUMENTS

| | | | |
|---|---|---|---|
| D. 229,608 | 12/1973 | Relfers et al. | D9/3 |
| 3,053,728 | 9/1962 | Emery | 162/228 |
| 4,481,243 | 11/1984 | Allen | 428/154 |
| 4,702,870 | 10/1987 | Setterholm et al. | 264/87 |
| 4,957,788 | 9/1990 | Colonel et al. | 428/33 |
| 5,174,863 | 12/1992 | Emery | 162/396 |
| 5,206,067 | 4/1993 | Bonzo | 428/119 |
| 5,382,464 | 1/1995 | Ruppel et al. | 428/172 |
| 5,443,889 | 8/1995 | Ruppel et al. | 428/172 |

*Primary Examiner*—Donald Loney
*Attorney, Agent, or Firm*—Marshall, O'Toole, Gerstein, Murray & Borun

[57] ABSTRACT

A unique method of producing a reinforced moulded sheet having one continuously planar face and having a plurality of ribs or thickened areas which provide a corresponding plurality of prominences directed outwardly of the other face, said prominences having predetermined shapes, locations and dimensions to serve as reinforced areas for said sheet. And a series of new or improved composite hollow moulded panels, each comprised of at least two co-extensive elements, each of said panels being reinforced and improved by the provision of at least one of said reinforced moulded sheets as an external element of said at least two co-extensive elements, the ribs or thickened areas of said reinforced sheet being glued internally of said hollow panel to the adjacent co-extensive element thereof.

9 Claims, 12 Drawing Sheets

COMPOSITE HOLLOW MOULDED PANELS AND METHODS OF MANUFACTURE

CROSS REFERENCE TO RELATED PATENTS

This application is a continuation-in-part of application serial number 08/247,009 filed May 20, 1994, now abandoned, and is a continuation-in-part of application Ser. No. 08/370,528 filed Jan. 9, 1995, now abandoned.

FIELD OF THE INVENTION

This invention relates to the methods of manufacturing composite hollow moulded panels.

BACKGROUND OF THE INVENTION

Composite hollow panels are known and in common use, such as the familiar container board comprised of a diaphragm of corrugated paperboard glued between two flat sheets of paperboard to form the strong but lightweight wall of a folding container, and a structural panel, used in Australia, made up from a diaphragm comprised of a continuous layer made from a multiplicity of moulded pulp egg trays (30 egg type) glued between two panels of plywood or pulpboard. The recent development of a hollow panel comprised of two ribbed elements is described in U.S. Pat. No. 4,702,870 to Setterholm in 1987, and an earlier development of a hollow panel, comprised of a single element formed by means of a multiplicity of moulding dies used in combination is described in U.S. Pat. No. 3,053,728 awarded to Emery in 1962.

The deeply ribbed hollow panel of U.S. Pat. No. 3,053,728 was comprised of a plurality of tubular preforms pressed together while still supported on the forming moulds and still immersed in the slurry of cement asbestos moulding materials. But the successful development of this project was abandoned when the dangers of working with asbestos became known.

The concept of a deeply ribbed composite hollow moulded pulp panel described in U.S. Pat. No. 4,702,870 provides for a matching network of deep ribs projecting from one face of each of the two co-extensive moulded pulp elements of which it is comprised, said elements being glued together internally of said hollow panel along the facing outer edges of said matching rib networks. The commercial success of this concept awaits the discovery and development of a practical and economical method of manufacture.

SUMMARY OF THE INVENTION

The essence of this invention is a unique method of manufacturing a moulded sheet or element preferably having a continuously planar surface at one side, and being reinforced by having a series of integrally moulded ribs or thickened areas directed outwardly of said sheet or element at the other side, thereby to create a series of new or improved composite hollow moulded panels, each comprised of at least two co-extensive elements glued together internally of said panel, and being reinforced by having at least one of said at least two co-extensive elements integrally moulded with said ribs or thickened areas by the method of this invention.

The preferred raw materials for the moulded elements of said panels are wood fibres or other cellulose fibres of the types used in the manufacture of paper. Selected waste papers or the sludge wastes of the paper mills may be used for this purpose in some instances. A moulded sheet manufactured and reinforced with ribs or thickened areas by the method of this invention may be used as a single sheet from which to manufacture a container or a display panel.

The unique method of manufacturing such an element reinforced by ribs or thickened areas of this invention require the design and production of a wet moulded preform with a consistency preferably of 25% to 30% solids which, depending upon the nature of the raw materials, allows the individual fibres some degree of freedom to disengage and reassemble when said preform is collapsed and compressed and further dewatered by pressure exerted externally upon said preform between a pair of heated finishing dies.

The practical success of this invention is ensured by the use of the well known and widely used wet vacuum moulding system as a preferred method for preparing a wet moulded preform, and the subsequent use of the equally well known hot press drying system, for finishing a moulded sheet reinforced with a plurality of ribs or thickened areas in its final form. When using this method, the minimum stages required are as follows:

1. Forming a wet preform by the wet vacuum moulding system whereby a foraminous moulding die having an uninterrupted wire mesh forming face is immersed in a thin slurry of moulding materials and a vacuum is applied to the side of the die opposite the moulding face, so that the transporting water of the slurry is drawn through the wire mesh and through a multiplicity of drain holes in the die so that the moulding materials are attracted to the moulding face of the die to form a wet preform with ribs or other prominences formed in or upon corresponding depressions or prominences in or upon the moulding face of the die in a layer of predictably uniform thickness and consistency, said thickness and consistency depending upon the precise nature of the moulding materials, the temperature and consistency of the slurry, the degree of vacuum applied, and the total time of immersion.

2. The transfer of the wet preform to a pair of pressing and drying dies for a final finishing stage, one or both of said pair of dies being foraminous to allow the escape of excess water and water vapour from the body of the wet preform during a pressing and drying operation, whereby a finished element is formed. Further, one or both of said pair of dies has a finishing surface heated to the temperature required to evaporate and drive off the excess water which may not have been expressed by the pressing action between the dies.

One or the other of said pair of pressing and drying dies will have a multiplicity of depressions aligned with the ribs or other prominences of the wet preform, each designed to contain, in a predetermined shape and reduced volume, most, or all of the entire mass of moulding materials of which the corresponding rib or prominence formed in the wet preform was comprised. In this way, the ribs or prominences are collapsed and compressed into the predetermined shape and volume required in their finished form. Further, a remainder of said mass of moulding materials in the ribs or prominences will, where required, compensate for any depressions or area of less consistency which may have existed in the opposite face of the preform underlying the base of said rib or prominence.

Optionally, additional moulding materials may be laminated to either face of the wet preform prior to the finishing operation, and/or by intermediate partial pressing with supplementary die forms.

Where required for exceptionally large and thick products beyond the scope of the wet vacuum moulding system, the wet preform may be prepared by the equally well known papier mache system where successive sheets of wet paper may be laminated together in a layer of uniform thickness over the entire moulding face of a wet moulding die which will in this way produce a wet preform of uniform thickness and consistency with the predetermined dimensions and characteristics required.

In each case, according to this invention, it is essential that the distribution of the mass of moulding material over the entire area of the preform provides at each rib or other prominence formed thereon, and at each of the unthickened areas thereof, the required mass of moulding materials to provide the predetermined level of uniformity over the entire area of the corresponding configurations of the finished element or sheet.

This invention provides also for the design and manufacture of a variety of preferred arrangements and dimensions of ribs and thickened areas to reinforce a single sheet or an external element (sheet) of a composite hollow moulded panel, which can be manufactured by combining and gluing together at least two co-extensive elements, at least one external element having been manufactured with reinforcing ribs or thickened areas according to one of the preferred designs and procedures of this invention.

The composite hollow moulded panels which can be made in this way by the assembly and gluing together of various combinations of co-extensive elements, and which are improved by the use of at least one reinforced element manufactured by the aforedescribed method as an external element, comprise embodiments of this invention, and may be used as structural panels and boards or as the walls of containers and other packaging items.

BRIEF DESCRIPTION OF THE DRAWINGS

In drawings which illustrate example embodiments of panels and panel elements constructed in accordance with this invention.

DETAILED DESCRIPTION OF PREFERRED EMBODIMENTS

Figure 1:
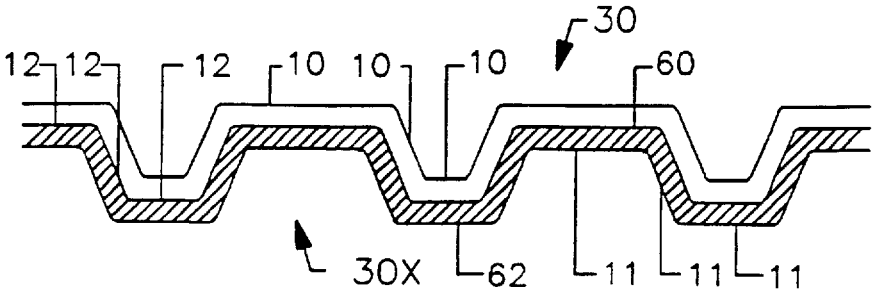
FIG. 1 is a cross sectional view of a portion of a panel element shown in both a wet preform state and final pressed and dried state.

In the drawings, FIG. 1 is a cross section through a portion of a wet moulded preform 30, showing the outlines 10 and 11 of said preform 30, and the outlines 12 and 11 of a finished element 30X into which it can be compressed, for example, into one half its original thickness, by using a mating hot press forming die with a moulding face in the shape of line 12, in any form of the well known hot press drying and finishing system. The final element has a plurality of ribs 60 on side 12 and a plurality of smaller ribs 62 on side 11. Conical projections could be formed on preform 30 in place of ribs 60, 62.

Figure 2A:
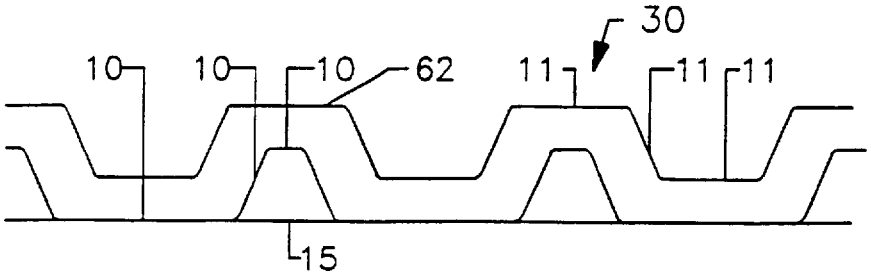
FIG. 2A is a cross sectional view of a portion of another panel element in a wet preform state.
Figure 2B:
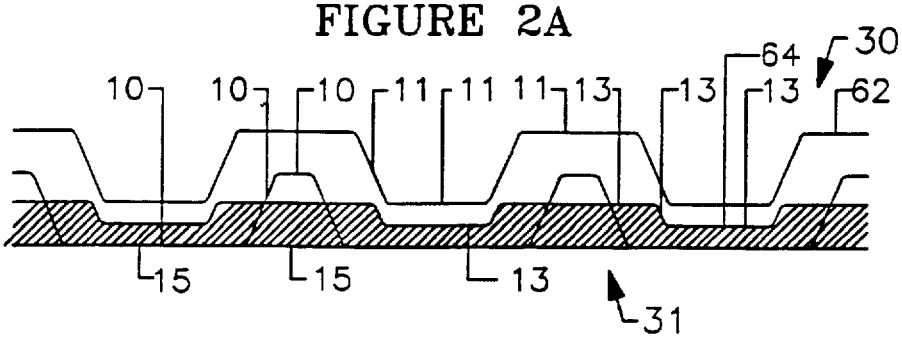
FIG. 2B is a cross sectional view of a portion of the panel element of FIG. 2A shown both in a wet preform state and final pressed and dried state.

FIG. 2A is a cross section through a portion of the wet preform 30 of FIG. 1, but with the surface along line 11 directed upwards, ready to present the smaller ribs 62 to the final hot press die with a moulding face in the shape of line 13 of FIG. 2B.

FIG. 2B is a cross section of the portion of the wet preform 30 shown in FIG. 2A, showing the final shape and reduced volume of the finished element 31 into which said wet preform 30 may be transformed by transfer into a pair of hot press drying dies, the first of said dies having a planar moulding face to produce the planar surface shown in profile along line 15, and the second of said dies having a moulding face as shown in profile along line 13, and in this example as shown, the volume of wet preform material included in and under each of said ribs 62 is designed to be compressed and densified to approximately one half the net volume contained in said rib 62 and the material immediately thereunder from which it was formed, with the remaining unthickened portions 64 of said wall of said finished element 31 being compressed to one half the wall thickness and volume of the related portions of said wet preform, thus assuring an approximately uniform density throughout the entirety of said finished element 31.

Figure 2C:
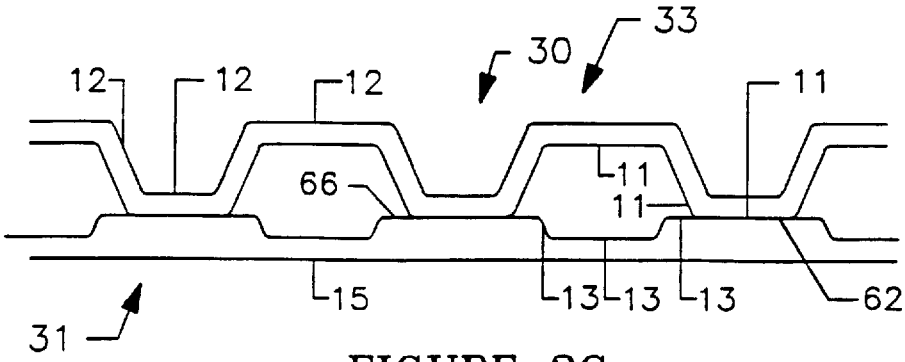
FIG. 2C is a cross sectional view through a portion of a composite panel.

FIG. 2C is a cross section through a portion of a composite hollow moulded panel 33, comprised of one finished element 30X and one finished element 31 glued together between the prominent surfaces of said ribs 62, 66 along line 11 of said element 31, thus providing one uninterrupted planar outer surface 15 and one ribbed or indented opposite surface 12 to said panel 33.

FIGS. 3A, 3B, 3C, 3D and 3E show typical arrangements and details of the moulding, transfer, and finishing dies of the wet vacuum moulding system.

Figure 3A:
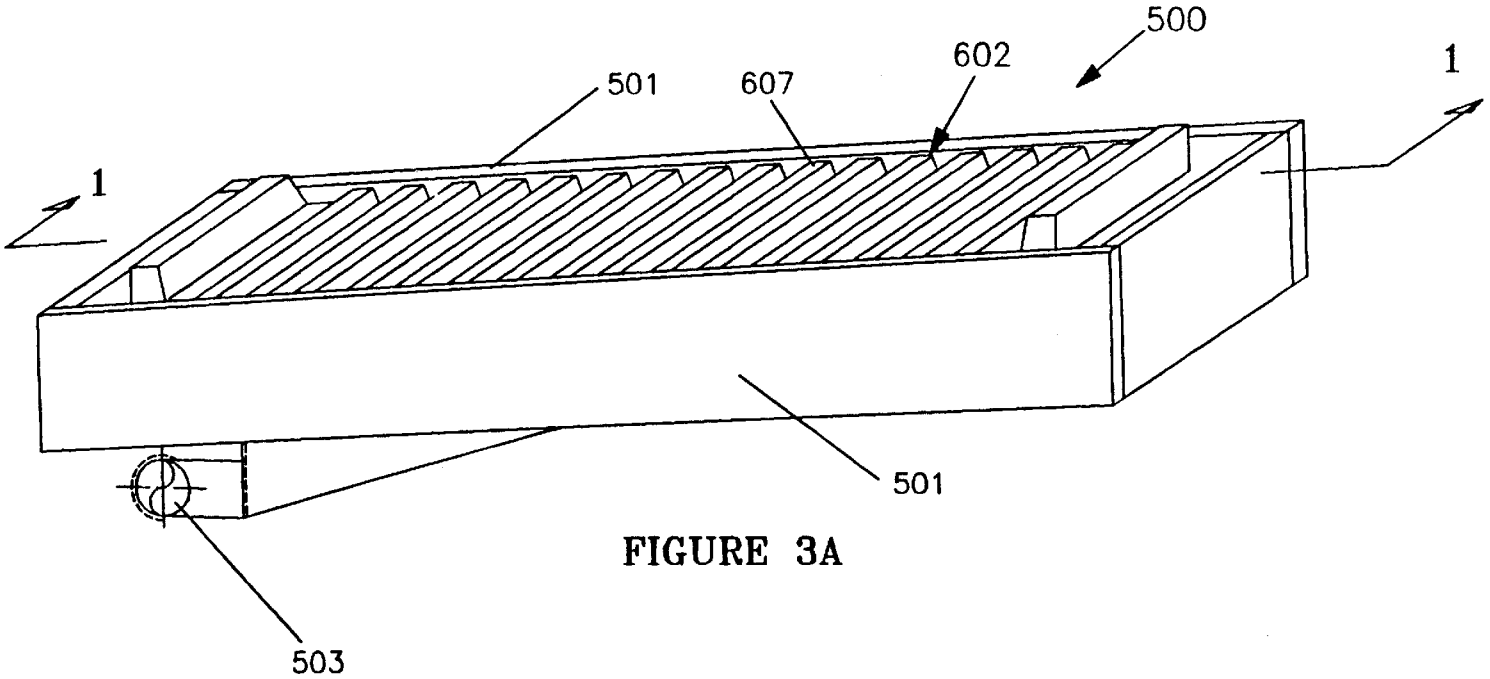
FIG. 3A is a perspective view of a typical vacuum wet forming die mounted in a supporting frame.

FIG. 3A is a perspective view of a wet forming die assembly 500, showing a wet vacuum forming die 602 with forming face 607, mounted in supporting frame 501, and with a vacuum source 503.

Figure 3B:
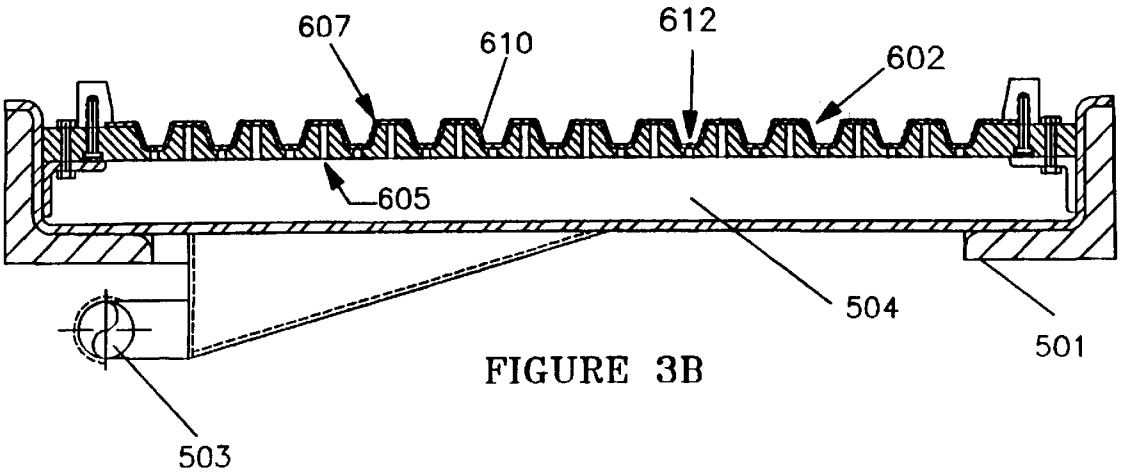
FIG. 3B is a cross sectional view at Section 1—1 of said vacuum forming die mounted in said supporting frame shown in FIG. 3A.

FIG. 3B is a cross section at line 1—1 of FIG. 3A and shows wet vacuum forming die 602 having an uninterrupted wire mesh surface 610 with a plurality of depressions 612. Die 602 has a plurality of vacuum drain holes 605 from the screened surface to a vacuum chamber 504, which is served by said vacuum source 503. Vacuum drain holes 605 make die 602 foraminous.

Figure 3C:
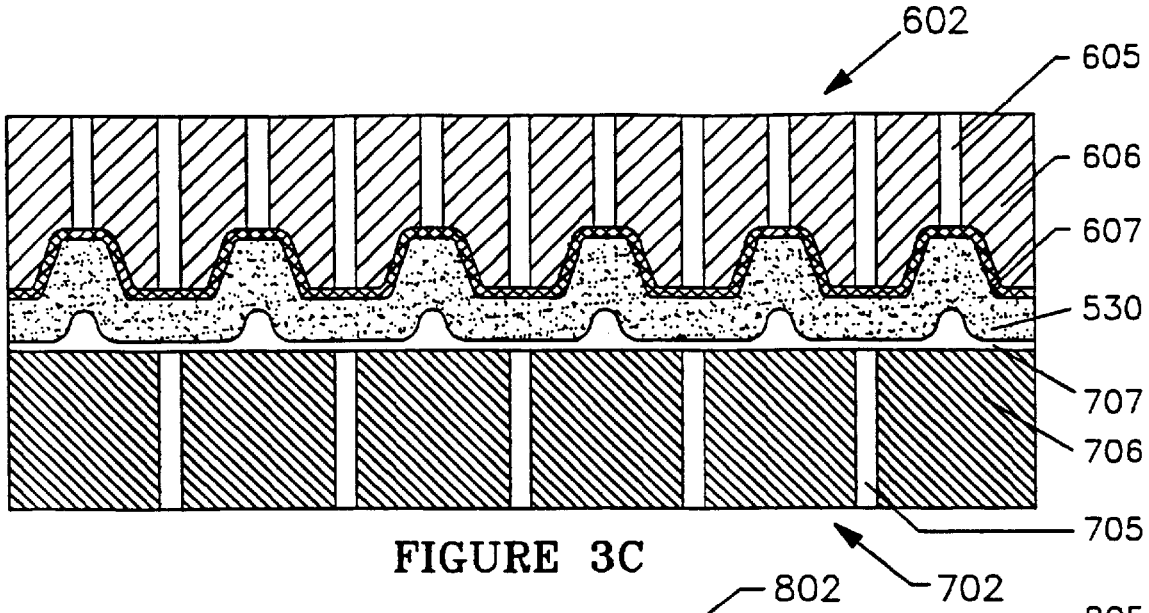
FIG. 3C is a cross section through a portion of said vacuum forming die mated with a corresponding portion of a first transfer die, with a portion of a wet preform enclosed between them.

FIG. 3C is a cross section through a portion of said foraminous wet forming die 602 showing the bronze body 606 of the die with drain holes 605 and wire mesh 610. With a vacuum applied to die 602 and the die immersed in a thin slurry of moulding materials, a wet preform 530 forms on the die. Thereafter, die 602 is removed from the slurry and mated with a first transfer die 702 having solid urethane body 706 with vacuum drain holes 705, such that a narrow gap 707 remains between the preform 530 and the urethane body 706 of the transfer die. At the moment of transfer, the supply of vacuum to said drain holes 605 of said forming die 602 is reversed and a supply of compressed air applied thereto, while at the same time a supply of vacuum is applied to said vacuum drain holes 705, thereby drawing said preform 530 out of contact with said forming die 602 and across said gap 707 into contact with said transfer die 702.

Figure 3D:
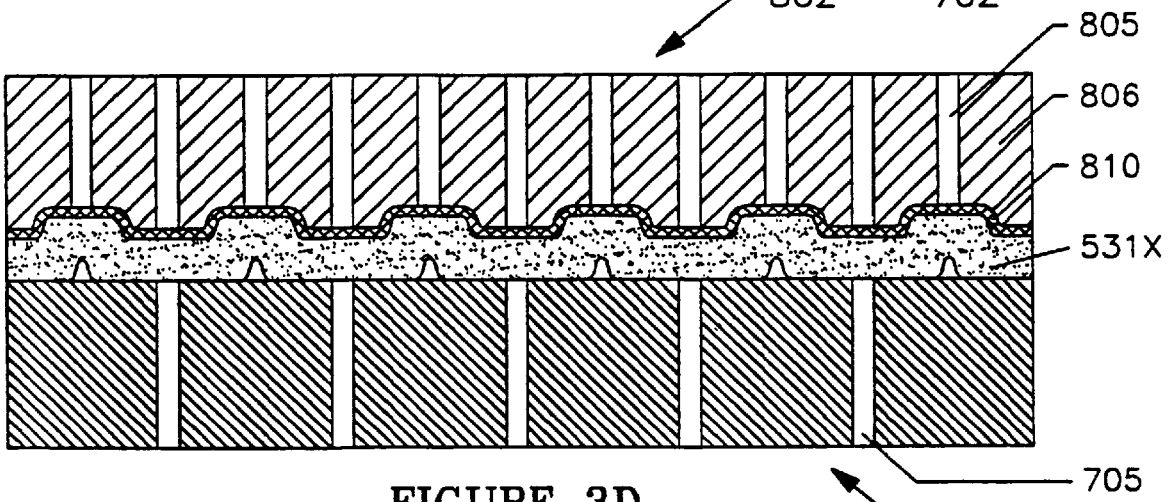
FIG. 3D is a cross section through said portion of said first transfer die mated with a portion of a second transfer die, with a partially compressed portion of said wet preform enclosed between them.

FIG. 3D is a cross section through a portion of said first transfer die 702 mated with a foraminous second transfer die 802 following a partial pressing action on said preform which is enclosed between said dies 702 and 802 resulting in preform 531X. Said second transfer die 802 is also fitted with wire mesh 810 continuous over the entire moulding face of the bronze body 806 of said second transfer die 802, and that portion of the contained water of said preform 530 which is expressed therefrom is drained off through the vacuum drain holes 805.

Figure 3E:
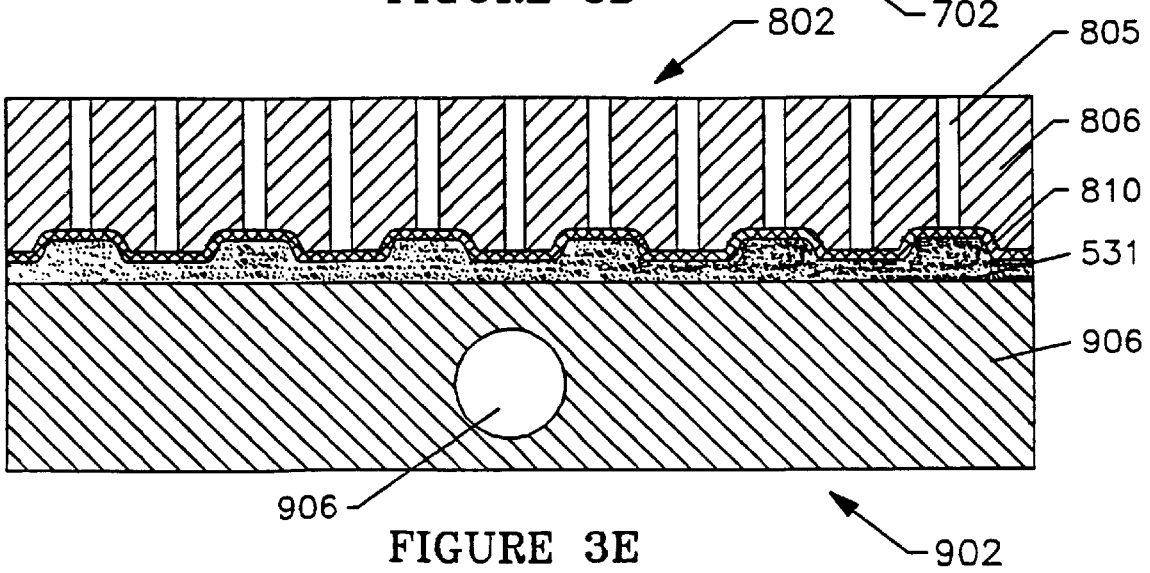
FIG. 3E is a cross section through said portion of said second transfer die mated with a portion of a heated finishing die, with the fully compressed portion of said wet preform between them during the drying operation.

FIG. 3E is a cross section through a portion of said second transfer die 802 mated with a heated pressing, drying, and finishing die 902, with said preform 531X pressed between said two dies into its final form 531 as a finished product. The body 906 of said finishing die is made of a special copper alloy combined with a small proportion of titanium or the like to preserve the high level of transmission of thermal energy from tubular heaters spaced at predetermined intervals in said body 906, and at the same time to preserve the hardened polished finishing surface thereof. The water and water vapour expressed from said preform 531X, during the final pressing and drying operation is transported along said wire mesh facing of said second transfer die 802 to discharge through said drain holes 805 thereof.

Figure 4:
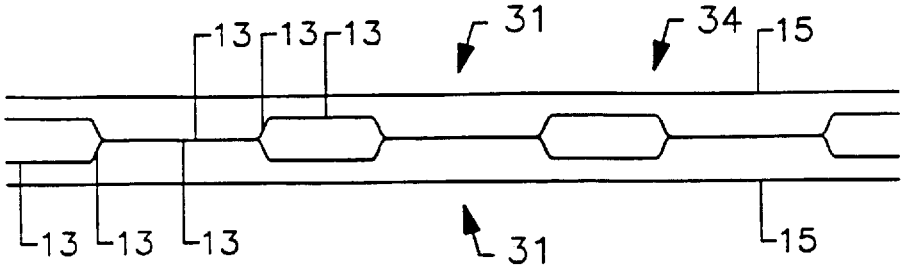
FIG. 4 is a cross sectional view through a portion of another composite panel.

FIG. 4 is a cross section through a portion of a composite hollow moulded panel 34, comprised of two elements 31, glued together at the mating prominent surfaces of their respective mating thickened areas along the sides 13 of each of said elements, thus providing uninterrupted planar surfaces on the two outer faces of said panel 34, along the sides 15 of said elements.

Figure 5A:
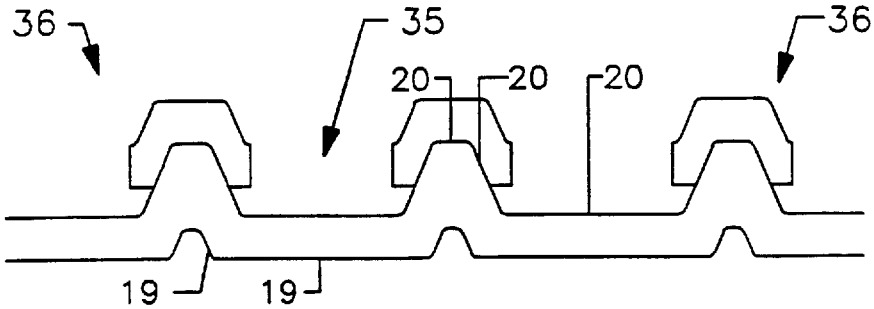
FIG. 5A is a cross sectional view through a portion of a primary panel element in a wet preform state, with three supplementary wet preforms superimposed thereon.

FIG. 5A is a cross section through a portion of a wet preform 35 showing supplemental wet preforms 36 superimposed upon the upwardly directed ribs or conical projections along line 20 of said preform 35 in a laminating process. These supplemental preforms may be formed by the same process as preform 530, previously described in conjunction with FIG. 3C.

Figure 5B:
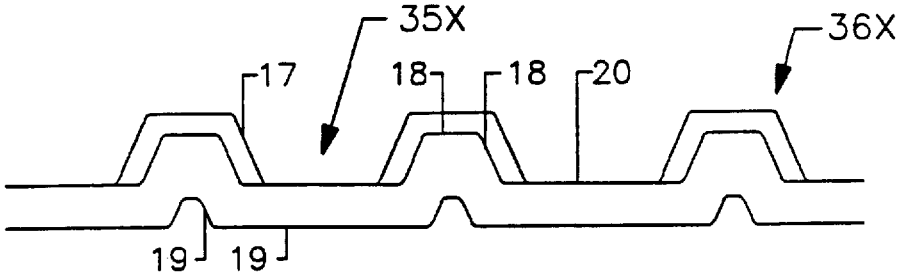
FIG. 5B is a cross sectional view through a portion of the panel elements of FIG. 5A, shown in an intermediate pressed state.

FIG. 5B is a cross section showing the wet preforms 35 and 36 in their intermediate wet pressed forms 35X and 36X as indicated in profile along lines 17 and 18, said intermediate pressing operation having been made between a pair of intermediate wet pressing dies, with the first of said dies having a moulding surface to retain the shape of one surface of said element 35X along line 19, and the second of said dies having moulding surfaces conforming to lines 17 on partly compressed preforms 36X and retaining the existing planar form of the remaining areas along line 20 of the preform 35X, thus tending to reduce the sideward spread of the upwardly directed projections now partly densified as indicated in profile along lines 18.

Figure 5C:
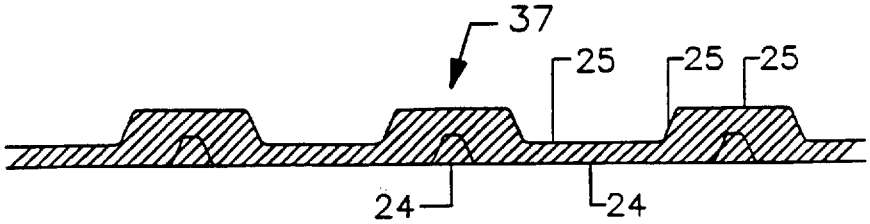
FIG. 5C is a cross sectional view of a portion of a panel element in its final state, formed from the wet preforms shown in FIGS. 5A and 5B.

FIG. 5C is a cross section of a portion of element 37 in the final finished form and reduced volume into which it can be compressed from the partially compressed wet preforms 35X and 36X by transfer into a pair of hot press drying dies, the first of said dies having an uninterrupted planar surface to form the planar surface indicated in profile along line 24, and the second of said dies having a moulding surface appropriate for forming the final shape of the other surface of said element 37, as indicated in profile along line 25, the net combined volumes of one of said elements 36, one of the upwardly directed projections along line 20 of said preform 35, and the material directly thereunder being compressed along line 20 to approximately one half of said volume in the related thickened area along line 25 of finished element 37, and the remaining planar areas of said preform 35 along line 20 being compressed to one half their thickness and volume between lines 25 and 24 of said finished element 37.

Figure 6:
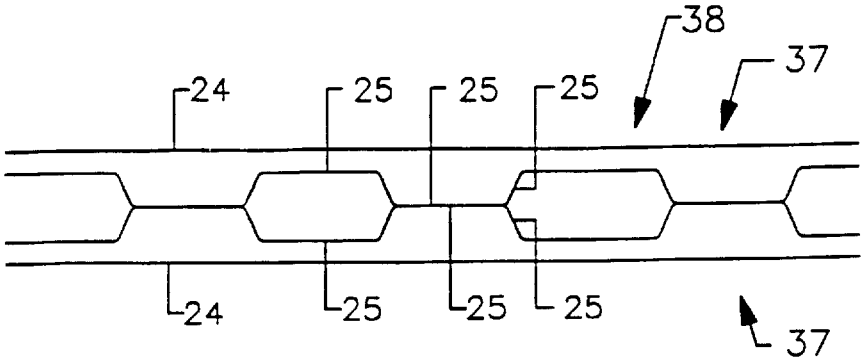
FIG. 6 is a cross sectional view through a portion of another composite panel, formed by combining two of the final elements shown in FIG. 5C.

FIG. 6 is a cross section of a portion of a composite hollow moulded panel 38, comprised of two of the finished elements 37 of FIG. 5C, glued together at the mating prominent surfaces of their respective thickened areas along the lines 25 of each of said elements 37, thus providing uninterrupted planar surfaces on each of the two outer faces of said panel 38, as shown in profile along lines 24 of said elements 37.

Figure 7:
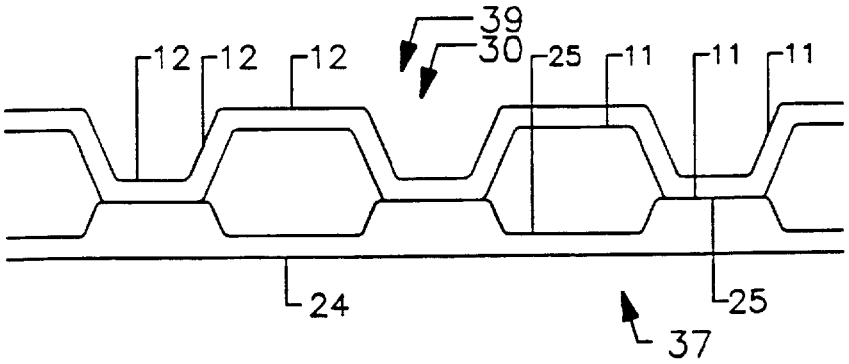
FIG. 7 is a cross sectional view through a portion of yet another composite panel formed by combining one each of the finished elements shown in FIG. 1 and FIG. 5C.

FIG. 7 is a cross section of a composite hollow moulded panel 39, comprised of one element 30 of FIG. 1 and one element 37 of FIG. 5C, glued together at the ribs or conical projections along line 11 of said element 30, and the mating prominent surfaces of the thickened areas along line 25 of element 37, thus providing one uninterrupted planar surface on one outer face of said panel 39 along line 24 of said element 37.

Figure 8A:
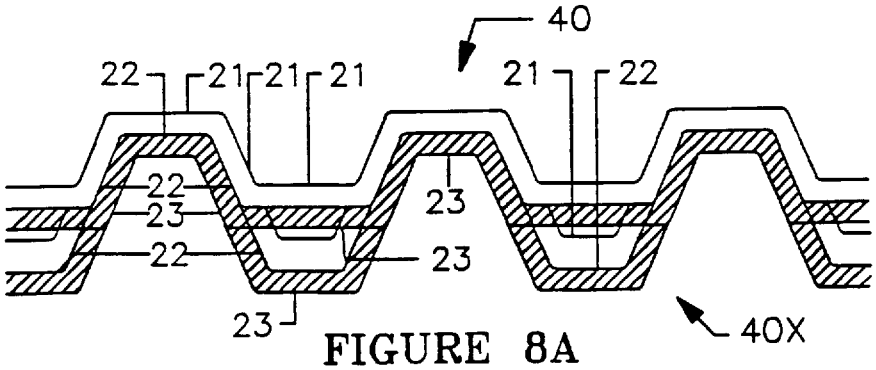
FIG. 8A is a cross sectional view through a portion of another panel element shown in the traditional egg tray form, shown in both an initial wet preform state and a final state.

FIG. 8A is a cross section of a portion of a wet preform 40 of the traditional egg tray shape, having projections above side 21 and projections below side 23, showing the final shape and reduced thickness as defined by lines 22 and 23 of the finished element 40X into which said preform 40 may be compressed and densified by the well known hot press drying process.

Figure 8B:
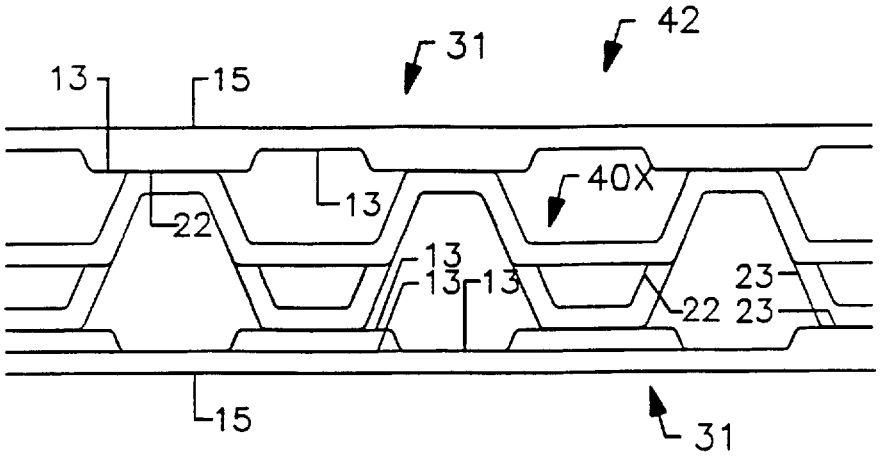
FIG. 8B is a cross sectional view through a portion of a panel formed from two of the panel elements 31 of FIG. 2B and one of the panel element 40X of FIG. 8A.

FIG. 8B is a cross section of a portion of a composite hollow moulded panel 42, comprised of one element 40X of FIG. 8 serving as a diaphragm, and two elements 31 of FIG. 2A serving as the outer elements of said panel 42, the first of said elements 31 being glued along the projecting thickened areas of line 13 to the projecting surfaces along line 22 of said element 40X, and the second of said elements 31 being glued along the projecting thickened areas of line 13 to the projecting surfaces along line 23 of said element 40, thus creating a panel with an uninterrupted planar surface at each outer face.

Figure 9A:
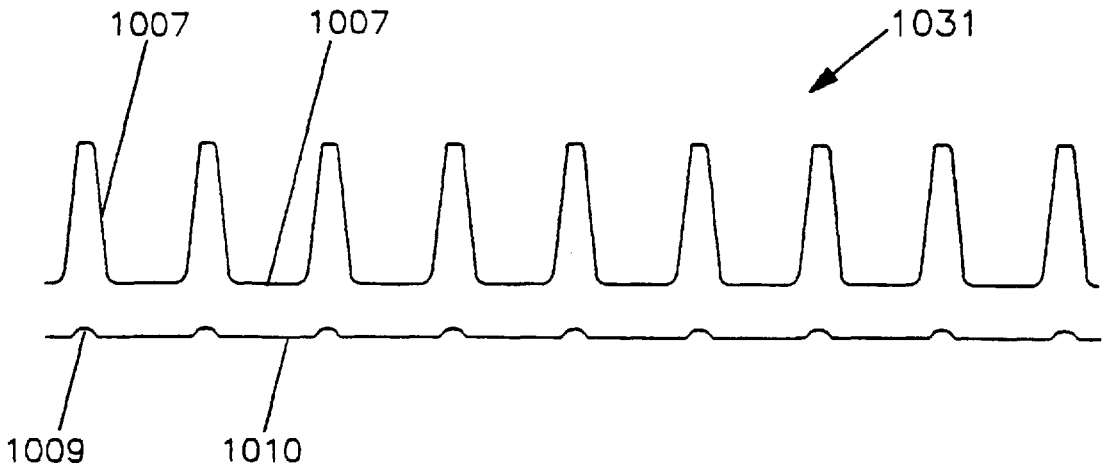
FIG. 9A is a cross sectional view of a portion of the wet preform of an element of a panel in which high ribs are required in the finished product.

FIG. 9A is a cross sectional view of a portion of a wet preform 1031 with deep ribs formed thereon, said wet preform having two faces, with a first face 1007 thereof formed upon the wire mesh forming face of a foraminous forming die by the wet vacuum forming process described in conjunction with FIG. 3B, the second and opposite face thereof, comprised of planar sections 1011 and with possible depressions or less dense areas 1012 on the outer face thereof.

Figure 9B:
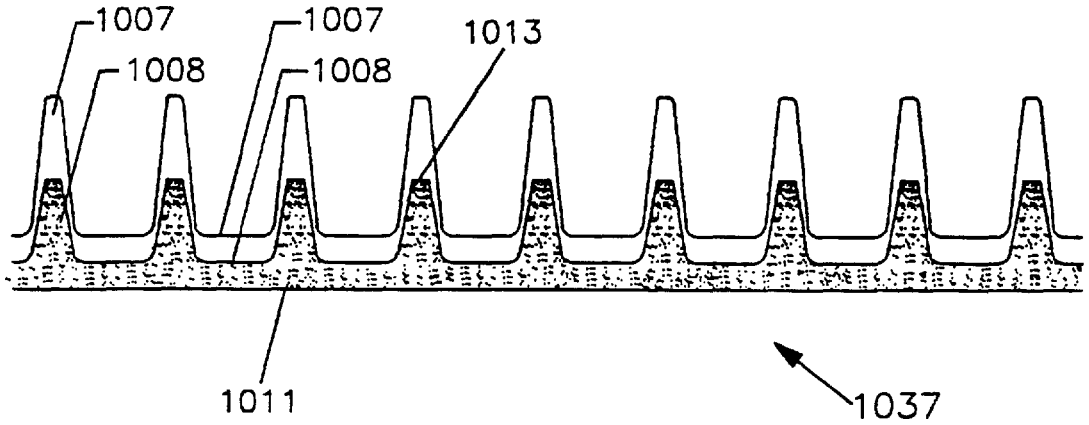
FIG. 9B is a cross sectional view of a portion of the finished element superimposed upon said cross sectional view of said portion of said wet preform of FIG. 9A.

FIG. 9B is a cross sectional view of said portion of said wet preform 1031 of FIG. 9A, with a cross sectional view of a corresponding portion of the finished element 1037 superimposed thereon, said finished element having been formed therefrom between a second transfer die and a heated finishing die by having been pressed between said transfer die and said heated finished die from the volume of said wet preform 1031 as defined by lines 1007, 1009 and 1011 to one half said volume as defined in said finished element 1037, by lines 1008 and 1011, and the gluing faces 1013.

Figure 9C:
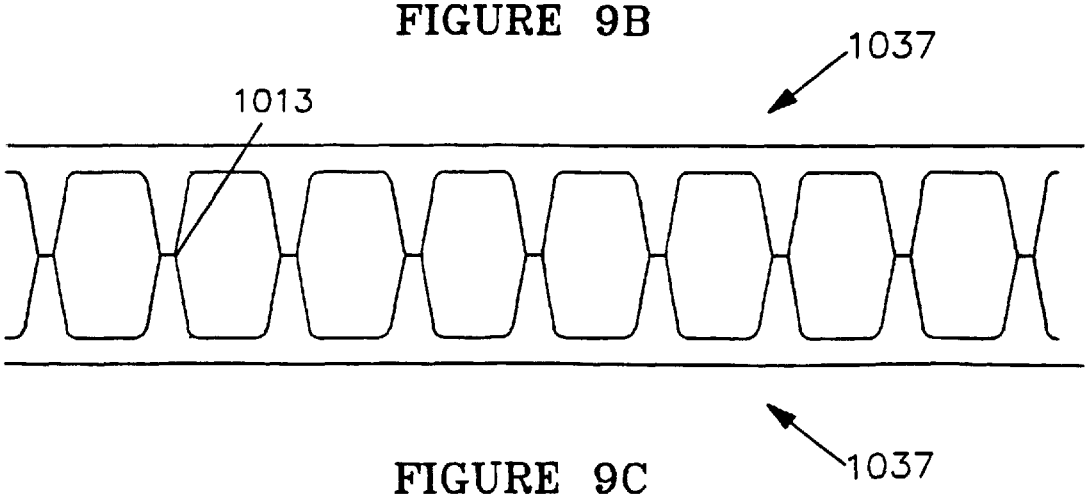
FIG. 9C is a cross sectional view of corresponding portions of two of said finished elements of FIG. 9B glued together internally to form a hollow panel.

FIG. 9C is a cross sectional view of said finished elements 1037 glued together internally of the hollow moulded panel so formed at the gluing faces 1013.

Figure 10:
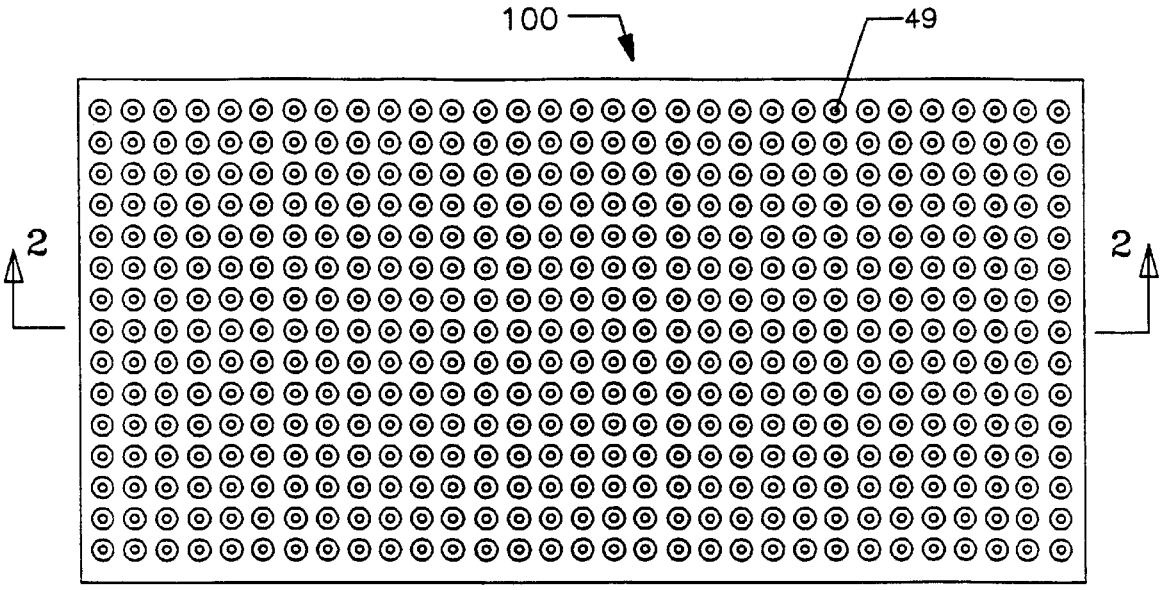
FIG. 10 is a plan view of another panel suitable for use as an acoustic ceiling panel.

FIG. 10 is a plan view of a composite hollow moulded panel 100, suitable for use as an acoustic ceiling panel or a drawer bottom comprised of two moulded elements glued together, with a regular pattern of indentions 49 on one face, as shown.

Figure 11A:
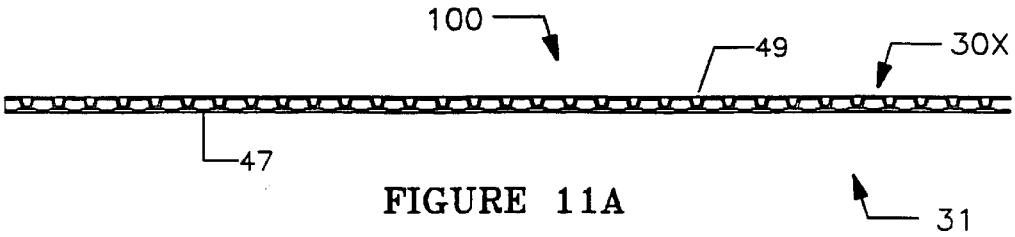
FIG. 11A is an edge view of the panel of FIG. 10.

FIG. 11A is an edge view of said panel 100 of FIG. 10 showing the internal construction formed by the two moulded elements of which it is comprised, element 130X which is similar to element 30X of FIG. 1 except that the ribs of element 30X have been replaced by conical projections 47, and element 31 of FIG. 2A, said indentations 49 of said element 130X being formed at the reverse side of the conical projections.

Figure 11B:
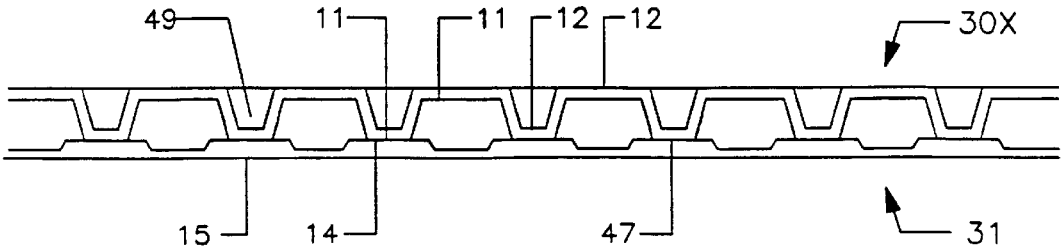
FIG. 11B is an enlarged edge view of a portion of the panel shown in FIG. 11A.

FIG. 11B is a cross section through a portion of the panel 100 of FIG. 10 taken at line 2—2, showing said indentations 49 formed along line 12 of said element 130X, and the related conical projections along side 11 of said element 30X glued to the prominent surfaces along line 14 of the mating thickened areas 66 of said element 31.

Figure 12:
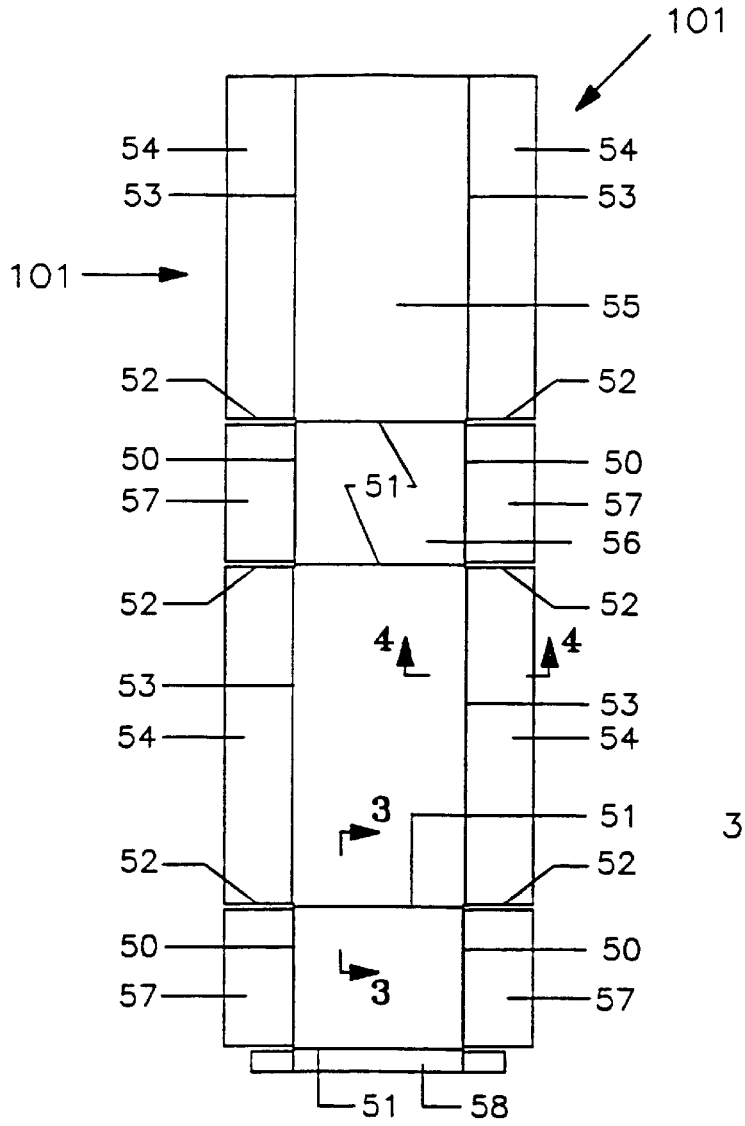
FIG. 12 is a plan view of a panel adapted to be folded into a container.

FIG. 12 is a plan view of a composite hollow moulded panel 101, similar to panel type 34 of FIG. 4, with one element 31 (of FIG. 2A) and one element 131 similar to element 31 but moulded complete with the cutouts 52 and fold lines 51 required to form a folding container when said two elements are glued together at the matching elongated prominences formed by the thickened areas on the inwardly directed faces of each of said elements. In use, a first end wall 56 is hingedly connected at two parallel edges and fold lines 51 to the adjacent first edge of a first side wall 55 and at the adjacent first edge of a second side wall 55, also a second end wall 56 is hingedly connected at a first edge and a fold line 51 to a second edge of said first side wall 55, and at a second edge and fold line 51 is hingedly connected to a flap 58 which may be stapled or glued to the free end of said second side wall 55, thereby to form the complete perimeter of said container, which is then closed by first folding in the four inner flaps 57 which are hingedly connected to the upper and lower edges of said end walls 56 at fold lines 50, and then folding in the four outer flaps 54, which in turn are hingedly connected at their edges to the upper and lower edges of said side walls 55 at fold lines 53.

Figure 13:
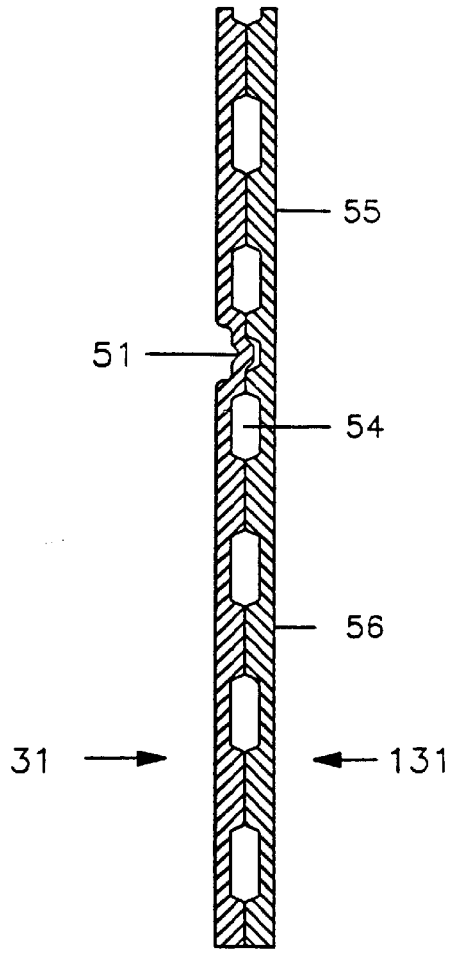
FIG. 13 is a cross sectional view of a portion of the panel of FIG. 12 along 3—3.

FIG. 13 is a cross section through a portion of a side wall 55 and of an end wall 56 of said panel 101 of FIG. 12, along 3—3, showing the thickened areas of the two elements 31 and 131 glued together at the glue lines 59, and details at the fold line 51.

Figure 14:
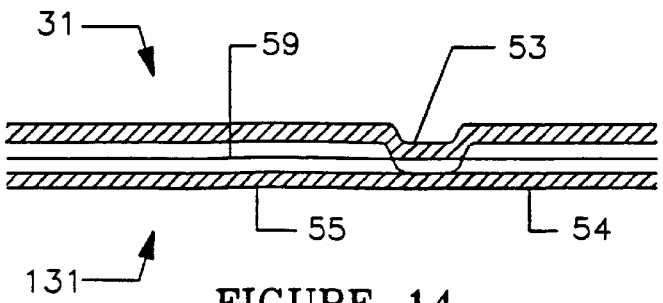
FIG. 14 is a cross sectional view of a portion of the panel of FIG. 12 along 4—4.

FIG. 14 is a cross section through a portion of a side wall 55 and an outer flap 54 of said panel 101 of FIG. 12 along 4—4, showing the glue line between two elongated thickened areas of said elements 31 and 231, and details of the fold line 53.

Figure 15:
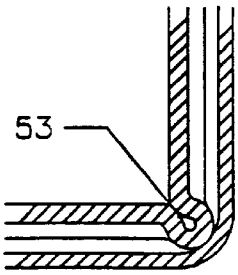
FIG. 15 is a cross sectional view similar to that of FIG. 14, folded at 90°.

FIG. 15 is a cross section through a portion of a side wall 55 and an outer flap 54 of said panel 101 showing details at fold line 53 when said panel is folded there at an angle of 90° between said side wall 55 and said outer flap 54.

Figure 16:
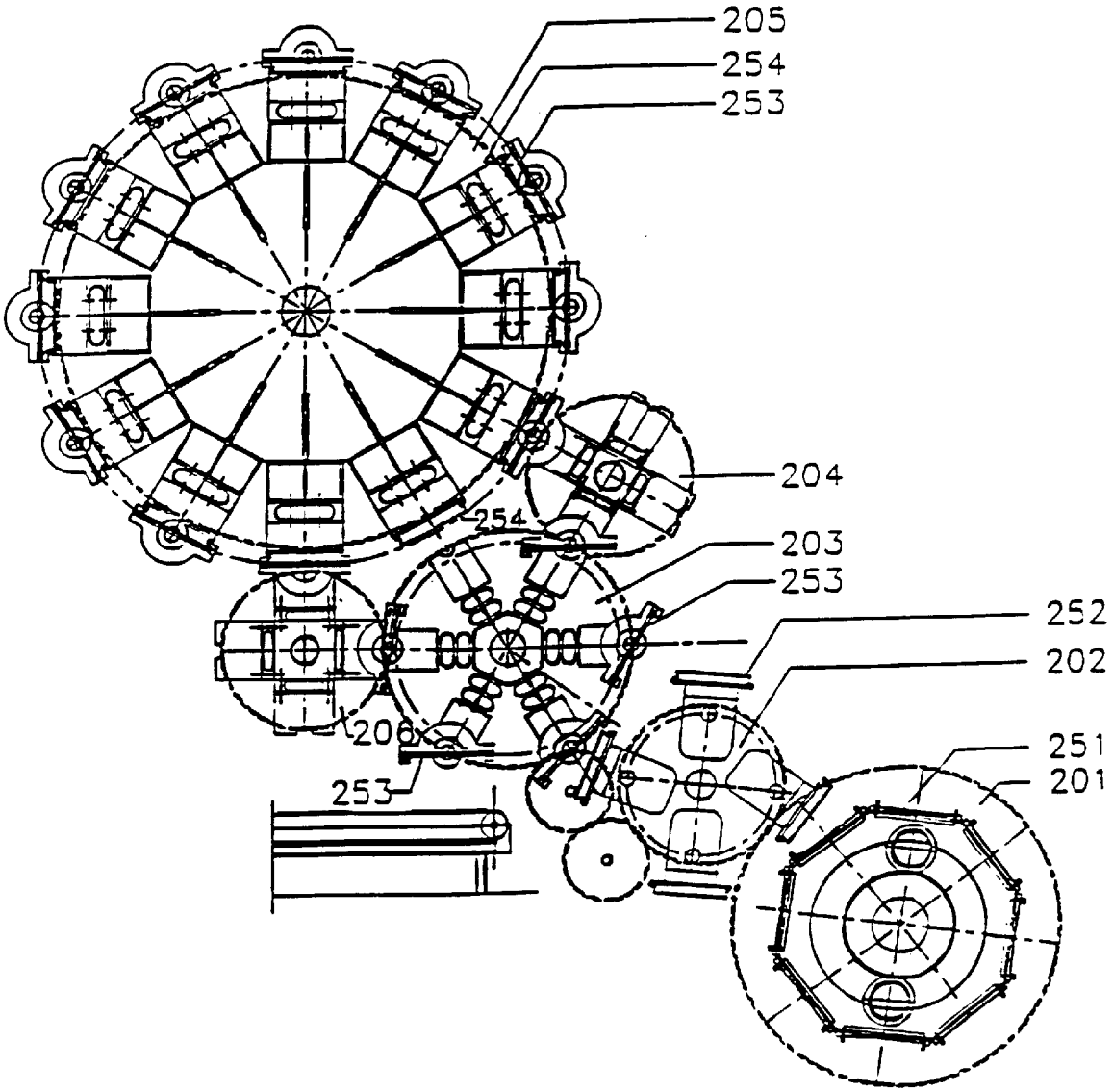
FIG. 16 is a diagram showing the general form of a pulp moulding machine with hot press drying equipment which can be used to manufacture the moulded panel element of FIG. 2B.

FIG. 16 is a diagram showing an example of a general arrangement of the locations for the moulding, transfer and pressing dies, and of the rotors by means of which said dies and the moulded items which they contain are transported in order to wet mould, collapse, densify and press dry the preform 30 of FIG. 2A into the finished element 31 of FIG. 2B. As shown in the diagram the wet forming dies 251 are transported on rotor 201 through the wet moulding process, and the wet preforms are transferred to the transfer dies 252, and from there transported on rotor 202 to be transferred to the flat faced pressing dies 253 releasably mounted on rotor 203. Said flat faced pressing dies, still containing the unchanged wet preforms, are then transferred by rotor 204 from said rotor 203 to rotor 205, where said flat faced dies 253, still containing the unchanged wet preforms, are locked into mated pressing position with heated pressing dies 254 which conform in shape to the outline 13 of the element 31 of FIG. 2A. The heated pressing dies 254 are then pressed against the wet preform 30 and towards the flat faced die 253, thus collapsing the wet moulded material projecting from side 11 of said element 30 and condensing the total material of said wet preform 30 into the final form of said finished element 31.

After the final product has remained between said pressing dies 253 and 254 for the required drying time, the said flat faced pressing dies 253 are unlocked and transferred from the mating position with said heated pressing dies 254 on rotor 206 and thence to rotor 203, from whence said finished products 31 are discharged from said flat faced pressing dies 253 and said empty dies 253 are then rotated on said rotor 203 to transfer position with said transfer dies 252 on rotor 202, to receive a new supply of said wet moulded preforms 30.

Figure 17:
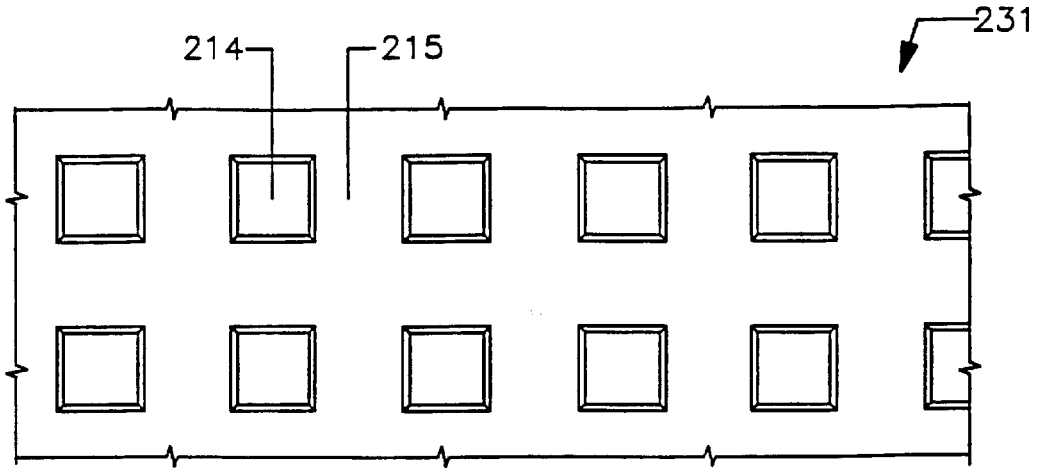
FIG. 17 is plan view of a portion of one side of a moulded element showing one of the variety of arrangements of thickened areas available.

FIG. 17 is a plan view of a portion of one face of the moulded external element 231 for the panel 100 of FIG. 10, with a plurality of isolated but regularly shaped projections 214, and intervening unthickened areas 215 on the inwardly directed face thereof, in one of the variety of arrangements available for use with said panel 100.

Figure 18:
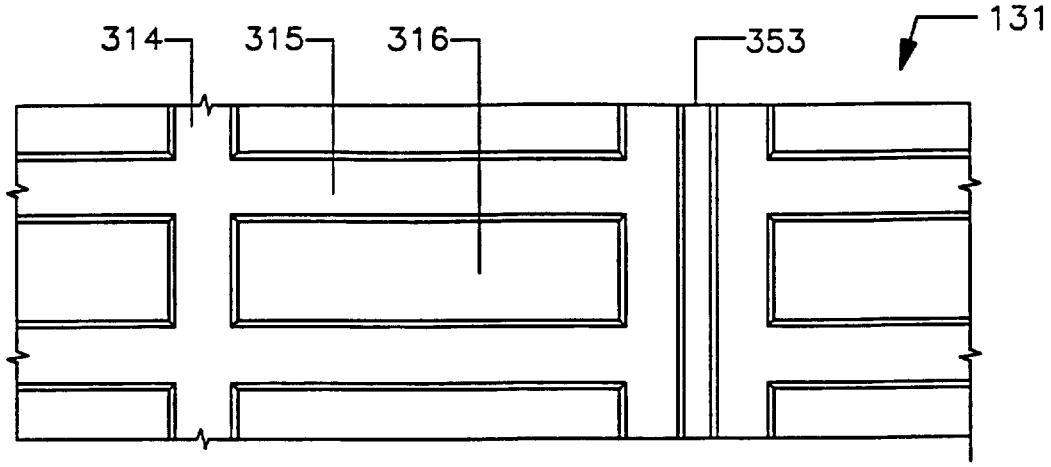
FIG. 18 is a plan of a portion of one side of a moulded element showing another one of the variety of arrangements of thickened areas available.

FIG. 18 is a plan view of a portion of one face of a moulded external element 131 of the panel 101 of FIG. 12, with a plurality of closely spaced parallel and elongated prominences 315 thereon, interrupted by a narrow unthickened area at the fold line 353, connected together at larger intervals with transverse prominences 314, and with intervening unthickened spaces 316 on the inwardly directed face thereof, in one of the variety of arrangements available for use with said panel 101.

Figure 19:
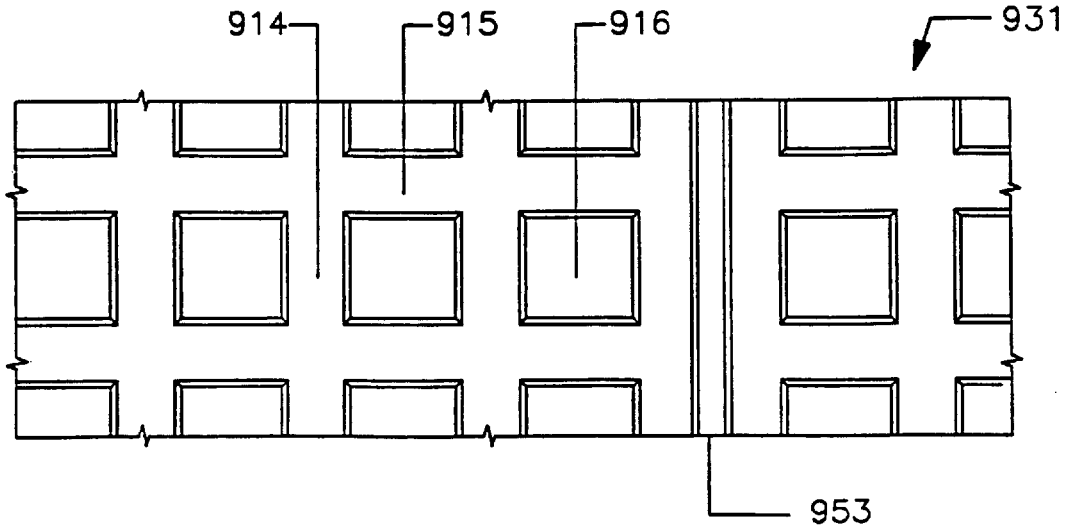
FIG. 19 is a plan view of a portion of one side of a moulded element showing a third one of the variety of arrangements of thickened areas available.
Figure 20:
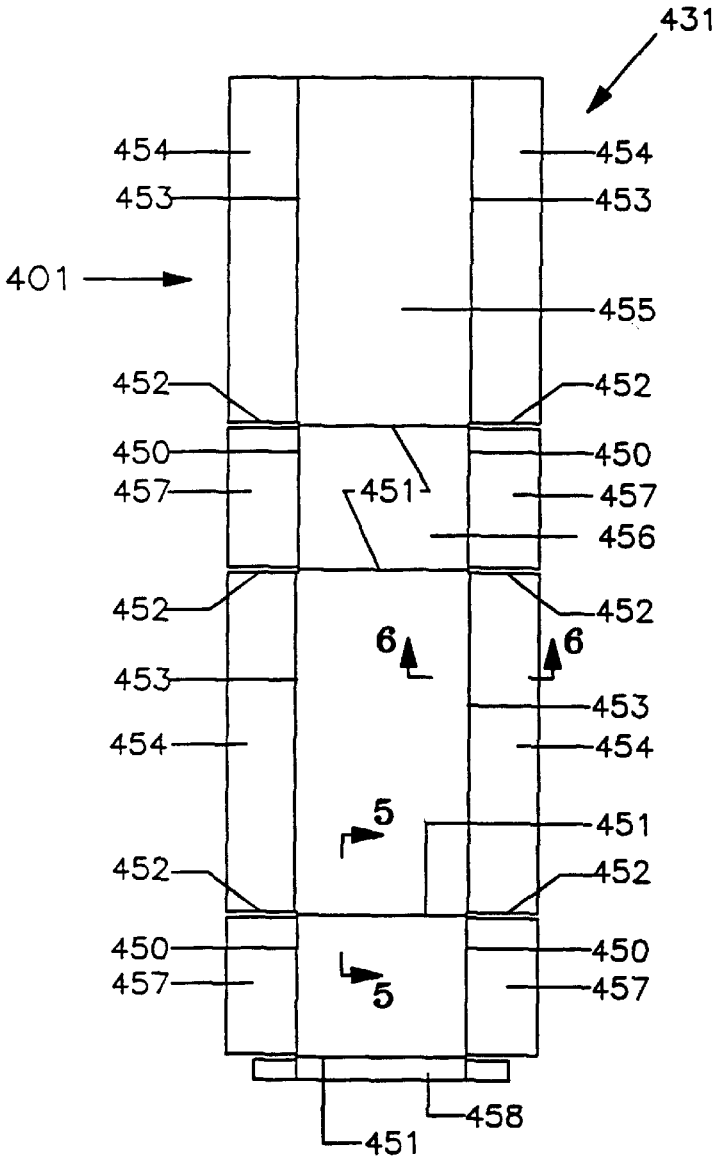
FIG. 20 is a plan view of the planar side of a single sheet with thickened reinforced areas, adapted to be folded into a container.

FIG. 19 is a plan view of a portion of a moulded sheet or element 931, which sheet may be used as an alternative to the moulded element 131 of panel 101 of FIG. 12, or as the single moulded sheet 431 of the panel 401 of FIG. 20. Said sheet or element has on one face thereof a network of prominences 914 and intervening unthickened areas 916, said network being interrupted by a continuous elongated unthickened area at each fold line such as shown at fold line 953, said network providing stability in both vertical and horizontal directions in the side wall or end wall of a container.

FIG. 20 is a plan view of the continuously planar surface of one face of the moulded sheet 431 of the folding container panel 401, said sheet 431 having a network of reinforcing prominences on its other face, similar to that shown in FIG. 19. Said sheet 431 of said container panel 401 has been moulded complete with the required perimeter, cutouts 452, and fold lines 450, 451 and 453 required to form a container. In use, a first end wall 456 is hingedly connected at two parallel edges and two fold lines 451 to the adjacent first edge of a first side wall 455 and the adjacent first edge of a second side wall 455, and a second end wall 456 is hingedly connected at a first edge and a fold line 451 to a second edge of said first side wall 455, and at a second edge and fold line 451 is connected to the adjacent edge of a flap 438, which may be glued or stapled to the free end of said second side wall 455, thereby to form the complete folded perimeter of said container, which is then closed by first folding in the four inner flaps 457 which are hingedly connected to the upper and lower edges of said end walls 456 at fold lines 450, and then folding in the four outer flaps 454, which are hingedly connected to said side walls 455 at their top and bottom edges and at fold lines 453.

Figure 21:
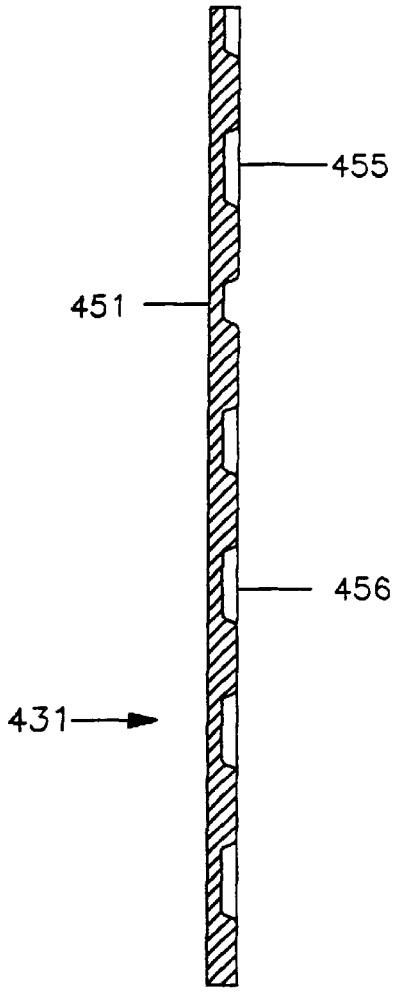
FIG. 21 is a cross sectional view of a portion of said single sheet of FIG. 20 along 5—5.

FIG. 21 is a cross section view along 5—5 of portions of a side wall 455 and an end wall 456 of said sheet 431 of FIG. 20, hingedly connected together at fold line 451.

Figure 22:
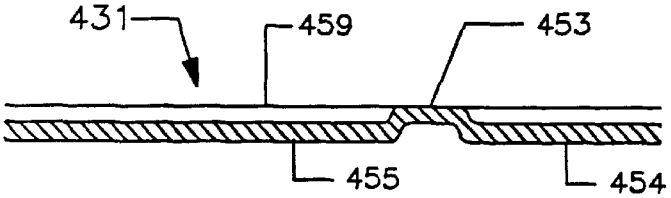
FIG. 22 is a cross sectional view of a portion of said single sheet of FIG. 20 along 6—6.

FIG. 22 is a cross section view of portions of a side wall 455 and an outer flap 454 of FIG. 20 along 5—5 hingedly connected together at fold line 453.

Figure 23:
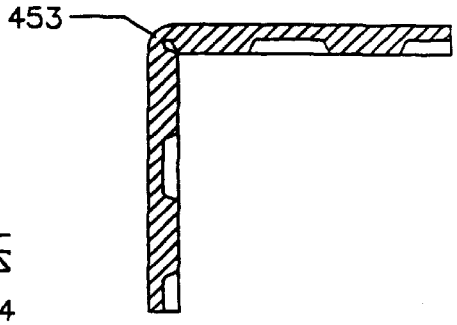
FIG. 23 is a cross sectional view of a portion of said single sheet of FIG. 20 along either 5—5 or 6—6, folded at 90°.

FIG. 23 is a cross section view of portions of a side wall 455 and at an outer flap 454 of FIG. 20 along 5—5 or 6—6 hingedly connected together and folded at 90° to each other at fold line 453, and showing details of the completed fold at said fold line 453.

What I claim is:

1. A method of forming a moulded pulp element with ribs or thickened areas comprising the steps of:

immersing a foraminous mould having an uninterrupted wire mesh forming face with a plurality of depressions or prominences into a thin slurry of moulding materials and applying a vacuum at said forming face to form a wet preform with a plurality of projections extending from a first face of said preform at predetermined locations corresponding to said depressions or prominences and with predetermined dimensions and volume to produce a predetermined mass of solids in each of said projections;

transferring said wet preform to a pair of hot press finishing moulds, at least one of said finishing moulds being heated to a drying temperature for said wet preform and at least one of said finishing moulds having a foraminous face for the escape of water vapour produced and excess water expressed in drying and pressing said preform, one of said finishing moulds being provided with depressed areas at predetermined locations;

pressing said pair of finishing moulds together to collapse and compress said preform to an element of predetermined final thicknesses, said depressed areas of said one finishing mould containing and collapsing said projections of said preform into projections of said element of predetermined dimensions.

2. The method of claim 1 including the steps of:

immersing a second foraminous mould having a second wire mesh forming face with a plurality of second foraminous mould depressions or prominences into a thin slurry of moulding materials and applying a vacuum at said second forming face so that moulding materials are attracted to said second forming face to form a plurality of supplemental masses at predetermined locations corresponding to said second foraminous mould depressions and with predetermined dimensions and volume;

depositing said supplemental masses upon projections of said preform to provide extra mass and height of moulding material for said preform.

3. The method of claim 1 including the steps of:

transferring said wet preform to an intermediate pair of wet pressing moulds having depressed areas for partially collapsing and compressing said projections; and pressing said intermediate pair of wet pressing moulds together to partially collapse and compress said projections and the unthickened areas therebetween.

4. The method of claim 2 including the steps of:

transferring said wet preform to an intermediate pair of wet pressing moulds having depressed areas for partially collapsing and compressing said projections; and pressing said intermediate pair of wet pressing moulds together to partially collapse and compress said projections and the unthickened areas therebetween.

5. The method of claim 1 wherein one of said finishing moulds has a continuously planar face for forming a planar face at a second face of said element.

6. The method of claim 2 wherein one of said finishing moulds has a continuously planar face for forming a planar face at a second face of said element.

7. A method of preparing a moulded element in the form of a single sheet reinforced at intervals by thickened areas by the method of claim 5, said element having two faces, a first face and a second face, said first face having integrally moulded thereon a network of broad flat-topped solid ribs projecting therefrom, arranged in parallel in two directions intersecting at an angle of 90°, and with the perimeter outline, cut outs and fold lines of a container blank, the foldable area for each fold line created by locating two of said parallel ribs one each side of said fold line and equidistant at a predetermined distance therefrom and by interrupting those portions of said network of ribs which would otherwise lie across the path of said fold line and between said two adjacent parallel ribs, thereby to create a foldable area of free sheet along the entire length of said fold line, said ribs parallel to said fold line being spaced apart a predetermined distance designed to provide pressure contact therebetween when said panel is folded at 90° along said fold line, said continuously planar surface of said second face to form the outer faces of said container.

8. A method of producing a foldable composite hollow panel comprised of two co-extensive elements, a first element and a second element, by means of the following steps:

(i) forming said first element by the method of claim 5, where said element has two faces, a first face and a second face, said first face having a plurality of broad flat-topped solid ribs projecting therefrom and directed inwardly of said panel, arranged in parallel in an overall pattern and topped with co-planar gluing surfaces, a first foldable area for a fold line lying parallel to said ribs being formed in the design of said moulds to locate two of said ribs, one at each side of said foldable area, parallel to and equidistant from said fold line whereby to create said first foldable area along the entire length of said fold line of a predetermined width whereby to admit a portion of a corresponding foldable area of said second element to make contact therewith along the entire length of said fold line when said panel is folded at an angle of 90°, said second face of said first element having a continuously planar surface to form the external faces of said panel, and where said parallel ribs lie across the path of one of said fold lines at an angle of 90°, a second foldable area for said fold line is created by interrupting each one of said ribs along the path of said fold line to create a gap therein of predetermined location, form and width, whereby to create an area of unreinforced and unthickened free sheet along the entire length of said fold line whereby to admit a portion of a corresponding foldable area of said second element when said panel is folded at an angle of 90°;

(ii) forming said second element by the method of claim 5, said second element having two faces, a first face and a second face, said first face having a plurality of said broad flat-topped solid ribs projecting therefrom and directed inwardly of said panel, arranged in parallel in an overall pattern and topped with co-planar gluing surfaces to correspond with said gluing faces in said first element, a first foldable area for a fold line lying parallel to said ribs being formed in the design of said moulds to locate two of said ribs, one at each side of said foldable area, parallel to and equidistant from said fold line whereby to create said first foldable area along the entire length of said fold line of a predetermined width of free sheet, a portion of said foldable area being directed inwardly of said panel whereby to make contact with the corresponding first foldable area of said first element along the entire length of said fold line when said panel is folded at an angle of 90°, said second face of said second element having a continuously planar surface to form the internal faces of said panel wherein said panel is folded at an angle of 90° except where said portion of said foldable area is directed inwardly of said panel along said fold line, and where said ribs lie across the path of one of said fold lines at an angle of 90°, a second foldable area for said fold line is created by interrupting each one of said ribs to create a gap therein of predetermined location, form and width whereby to create an area of unthickened and unreinforced free sheet along the entire length of said fold line, a portion of said free sheet being directed inwardly of said panel in a form whereby to make contact with the corresponding second foldable area of said first element along the entire length of said fold line when said panel is folded at an angle of 90°;

(iii) gluing said co-planar gluing faces of said first element to said corresponding co-planar gluing faces of said second element in a manner which will register said first and second foldable areas and fold lines of said first element with said corresponding first and second foldable areas and fold lines of said second element.

9. A method of producing a foldable composite hollow panel comprised of two co-extensive elements, a first element and a second element, by means of the following steps:

(i) forming said first element as a single sheet with two faces, a first face and a second face, said first face having a continuously planar surface directed inwardly of said panel, and said second face having a continuously planar surface to form the external face of said panel;

(ii) forming said second element by the method of claim 5, said second element having two faces, a first face and a second face, said first face having a plurality of broad flat-topped solid ribs projecting therefrom and directed inwardly of said panel, arranged in parallel in an overall pattern and topped with co-planar gluing surfaces, a first foldable area for a fold line lying parallel to said ribs being formed in the design of said moulds to locate two of said ribs, one at each side of said foldable area, parallel to and equidistant from said fold line whereby to create said first foldable area along the entire length of said fold line of a predetermined width of free sheet, a portion of said free sheet lying between said two parallel ribs lying at either side of said foldable area being directed inwardly of said panel to make contact with the adjacent face of said first element along the entire length of said fold line when said panel is folded at an angle of 90°, said second face of said second element having a continuously planar surface to form the internal faces of said panel, except where directed inwardly of said panel at said fold line, and where said ribs lie across the path of one of said fold lines at an angle of 90°, a second foldable area for said fold line is created by interrupting each one of said ribs to create a gap therein of predetermined location, form and width whereby to create an area of unthickened and unreinforced free sheet along the entire length of said fold line, a portion of said free sheet being directed inwardly of said panel in a form whereby to make contact with the corresponding second foldable area of said first element along the entire length of said fold line when said panel is folded at an angle of 90°;

(iii) gluing said co-planar surfaces of said first element to the adjacent planar surface of said first element.

* * * * *